US006382458B2

(12) United States Patent
Mori

(10) Patent No.: US 6,382,458 B2
(45) Date of Patent: May 7, 2002

(54) TRANSPORTATION CONTAINER

(75) Inventor: Kiyoyoshi Mori, Tsushima (JP)

(73) Assignee: Toyota Tsusho Corporation, Nagoya (JP)

( * ) Notice: Subject to any disclaimer, the term of this patent is extended or adjusted under 35 U.S.C. 154(b) by 0 days.

(21) Appl. No.: 09/783,627

(22) Filed: Feb. 14, 2001

(30) Foreign Application Priority Data

Feb. 21, 2000 (JP) ..... 2000-042237

(51) Int. Cl.[7] ..... B65D 25/32

(52) U.S. Cl. ..... 220/763; 220/772; 220/775; 220/756; 206/506

(58) Field of Search ..... 220/72, 773, 775, 220/769, 765, 762, 763, 756; 206/506

(56) References Cited

U.S. PATENT DOCUMENTS 2,224,681 A * 12/1940 Hovorka ..... 206/506
2,244,841 A * 6/1941 Johnson ..... 206/506
2,297,097 A * 9/1942 Best ..... 206/506
2,552,929 A * 5/1951 Bodkin ..... 206/506
5,335,789 A * 8/1994 Taravella et al. ..... 206/506

* cited by examiner

*Primary Examiner*—Stephen Castellano
(74) *Attorney, Agent, or Firm*—Koda & Androlia

(57) ABSTRACT

A transportation container includes a body having a plurality of side walls, a bottom and an open upper end, a pair of handles mounted on the body so as to be rotated inside or outside the body and including grip portions having both ends respectively, a pair of arms formed on the respective ends of each grip portion of each handle, and a pair of engaging portions formed on an interface between each grip portion and the corresponding arm. The side walls of the body are inclined downwardly inward so that a cross-sectional area of the body is gradually decreased from the upper end to the bottom of the body. Each arm has a distal end mounted on an outer face of one of the side walls of the body so that each handle is rotated inside or outside the body. Each engaging portion engages the upper end of the body, and each grip portion extends across the open upper end of the body and is located lower than an upper end of the side wall when each handle is rotated inside the body. Each engaging portion disengages from the upper end of the body and each grip portion being rotated outside the body when the handle is rotated outside the body.

4 Claims, 7 Drawing Sheets

TRANSPORTATION CONTAINER

BACKGROUND OF THE INVENTION

1. Field of the Invention

This invention relates to containers repeatedly used for transportation of products.

2. Description of the Prior Art

The prior art has provided a transportation container of the above-mentioned type made of plastic and having side walls inclined downwardly inward so that a cross-sectional area of a body is gradually decreased from an open upper end to a bottom of the body. When not used for the product transportation, a number of the containers are fitted into one another to be laid one upon another while prevented from becoming bulky.

In use for the product transportation, products are accommodated into the container and a lid is then put onto the open upper end of the container. The containers are then laid one upon another. Since the lid and container are discrete from each other, the lid is prone to be lost. When the lid is lost, the container cannot be laid upon another during transportation.

Furthermore, since the side walls of the prior-art container are inclined downwardly inward, the containers can be laid one upon another without becoming bulky. However, when a large number of containers are fitted with one another to be laid one upon another, the containers cling to one another due to self-weight. As a result, the containers are not easily separated from one another.

SUMMARY OF THE INVENTION

Therefore, a primary object of the present invention is to provide a transportation container which can be laid on another container to be stowed away or kept in safety when not used for transportation and can be laid on another container without a lid while containing products therein.

Another object of the invention is to provide a transportation container which can easily be detached from another container even when a large number of containers are laid one upon another.

Further another object of the invention is to provide a transportation container which has a sufficient durability to be used repeatedly.

The present invention provides comprising a body having a plurality of side walls, a bottom and an open upper end with two pairs of corners. The side walls are inclined downwardly inward so that a cross-sectional area of the body is gradually decreased from the upper end to the bottom of the body. A pair of handles are mounted on the body so as to be rotated inside or outside the body and including grip portions having both ends respectively. A pair of arms are formed on the respective ends of each grip portion of each handle. Each arm has a distal end mounted on an outer face of one of the side walls of the body so that each handle is rotated inside or outside the body. A pair of engaging portions are formed on an interface between each grip portion and the corresponding arm. Each engaging portion engages the upper end of the body and each grip portion extending across the open upper end of the body and being located lower than an upper end of the side wall when each handle is rotated inside the body. Each engaging portion disengages from the upper end of the body and each grip portion is rotated outside the body when the handle is rotated outside the body.

According to the above-described construction, the arms of each handle are mounted on the outer faces of the side walls of the body. When each handle is rotated outside the body, one container can be fitted into another container to be laid upon another. Consequently, since the containers are laid one upon another to be kept in safekeeping when not used for transportation, a space required for safekeeping can be saved.

When products are put into the containers, each handle is rotated inward so that each engaging portion engages the upper end of the side wall of the body. As a result, since the grip portion of each handle extends across the open upper end of the body, the bottom of one container is placed on the grip portions of another container, whereby the containers can be laid one upon another. Further, each grip portion is located lower than the upper end of the body when each engaging portion has engaged the upper end of the body. Accordingly, the bottom of the container laid upon another container is fitted into the interior of the lower container. Consequently, even if the containers are slid more or less during transportation, the bottom of the upper container strikes against the inside of the upper end of the body such that the containers are prevented from falling down.

In a preferred form, the transportation container further comprises a stopper protruding from an upper outer face of one of the side walls of the body. In this construction, when the body of one transportation container is fitted into the body of another transportation container so that the containers are laid one upon the other, the stopper of said other container strikes against an upper end of one of the side walls of said one container such that a space is defined between the underside of said one container and the bottom of said another container. When one container is fitted into another container to be laid upon the latter, a space is defined between the bottoms of the containers laid one upon another. Consequently, the containers can be prevented from clinging to one another, whereupon the containers are not easily separated from one another.

In another preferred form, each arm includes a stepped portion dividing each arm into an upper half portion and a lower half portion both extending lengthwise with respect to each arm, and the lower half portion of each arm of one container is placed inside the upper half portion of each arm of another container when said one container is fitted with said another container to be laid upon said another container. When one container is fitted with another container thereby to be laid upon another, the lower half portion of each arm of one container is fitted in the upper half portion of each arm of another container, so that the arms are partially overlapped. Consequently, since the dimension of a protruding portion of each arm or grip portion is reduced, a space used for safekeeping of the container can be reduced.

In further another preferred form, each grip portion has a generally square section. Consequently, since the bottom of one container is stably laid on the grip portions of another container, the containers can easily be laid one upon another.

In further another preferred form, the body has at least one corner. In this construction, the container further comprises a generally L-shaped bracket secured to an outer face of the corner of the body, the stopper being formed integrally on the bracket. Since the corner of the body is reinforced by the bracket, the container is hard to deform due to the self weight when products are accommodated therein and the container can repeatedly be used.

BRIEF DESCRIPTION OF THE DRAWINGS

Other objects, features and advantages of the present invention will become clear upon understanding of the following description of a preferred embodiment, made with reference to the accompanying drawings, in which.

DETAILED DESCRIPTION OF PREFERRED EMBODIMENT

Figure 1:
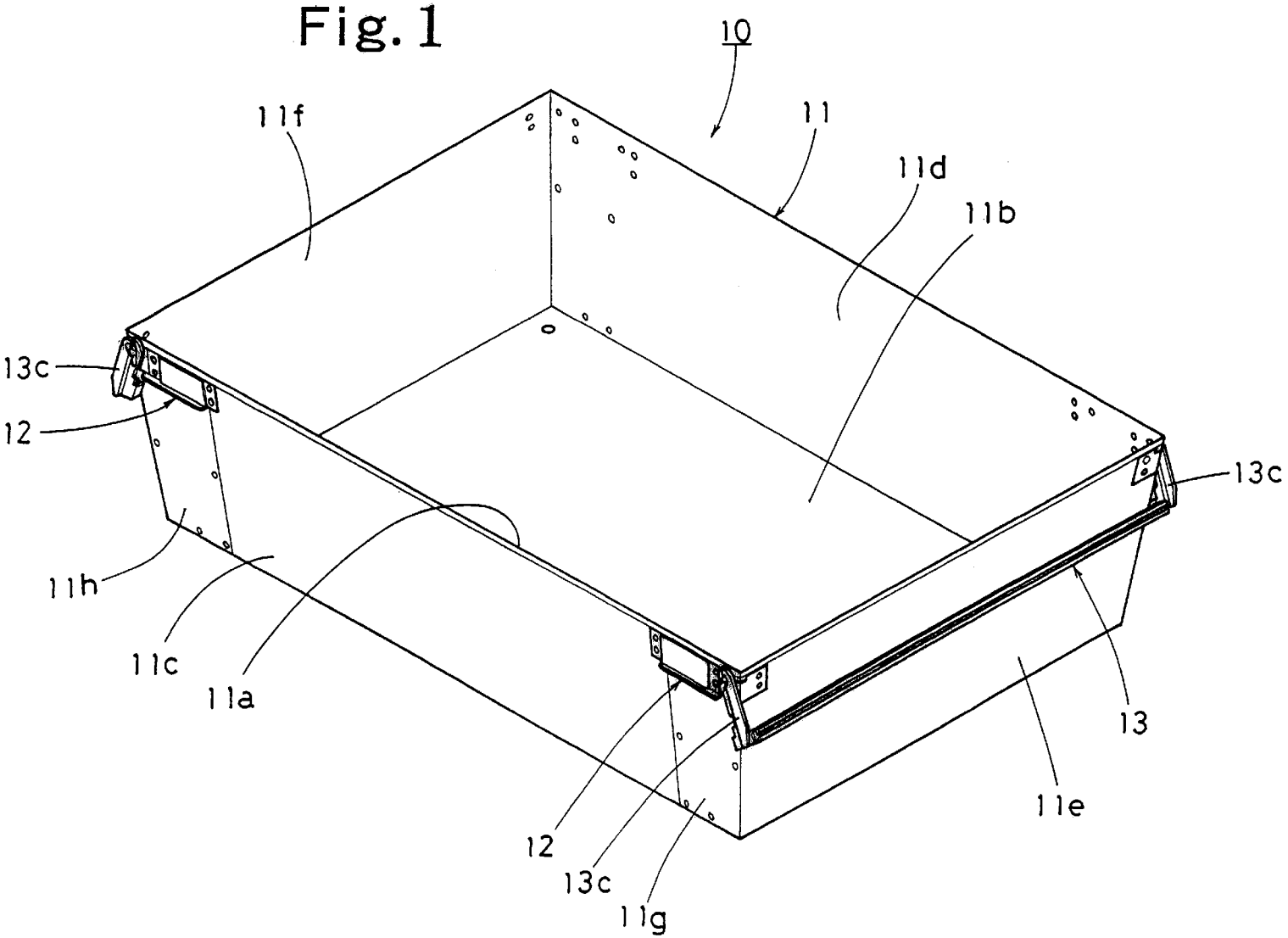
FIG. 1 is a perspective view of a transportation container of one embodiment in accordance with the present invention, showing the state where handles have been rotated inside the body.
Figure 2:
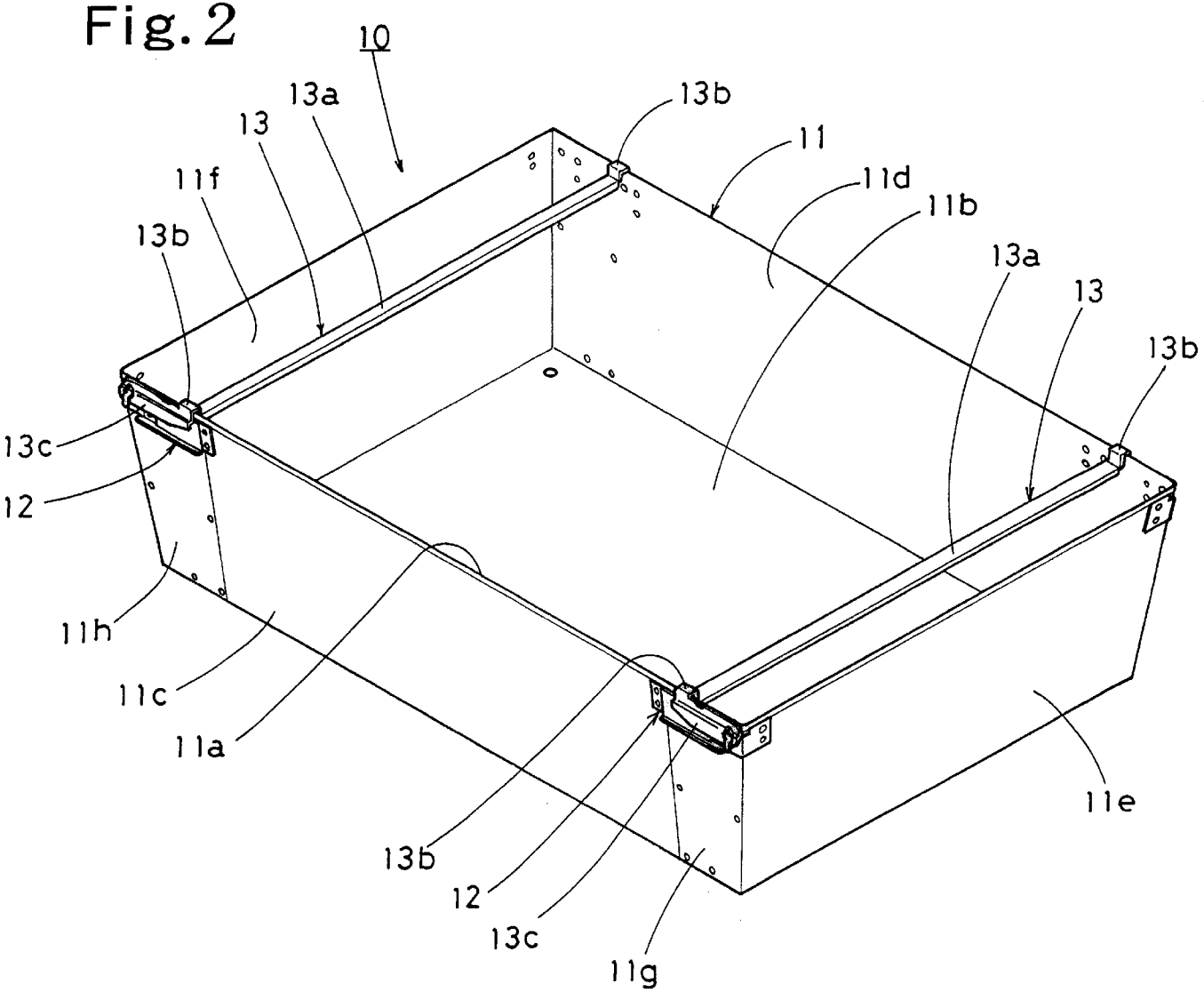
FIG. 2 is also a perspective view of the transportation container, showing the state where the handles have been rotated outside the body.

One embodiment of the present invention will be described with reference to the accompanying drawings. Referring to FIGS. 1 and 2, a transportation container 10 of the embodiment is shown. The container 10 comprises a generally box-shaped body made of a steel plate and a pair of handles 13 rotatably mounted on the body 11 by generally L-shaped brackets 12. The body 11 has a generally rectangular open upper end 11*a*, a bottom 11*b* and four side walls 11*c* to 11*f*. The side walls 11*c* to 11*f* are inclined downwardly inward so that a cross-sectional area of the body 11 is gradually decreased from the upper end to the bottom of the body 11. The side wall 11*e* has both ends formed with bent portions 11*g* respectively. The side wall 11*f* has both ends formed with bent portions 11*h* respectively. The bent portions 11*g* of the side wall 11*e* are welded to the side walls 11*c* and 11*d* respectively. The bent portions 11*h* of the side wall 11*f* are also welded to the side walls 11*c* and 11*d* respectively.

Figure 3:
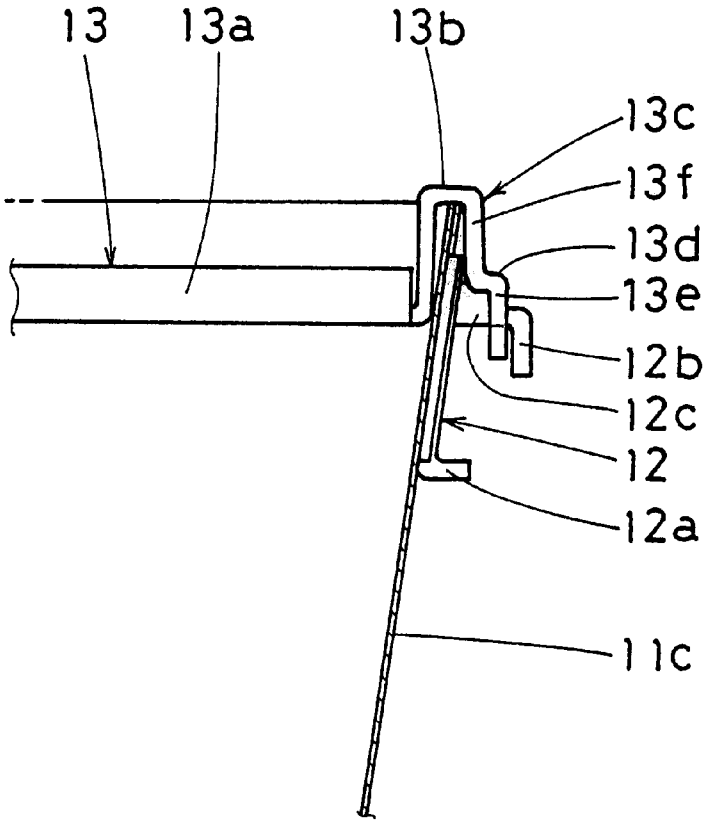
FIG. 3 is a partial sectional view of a mounting portion of a handle of the container.
Figure 4:
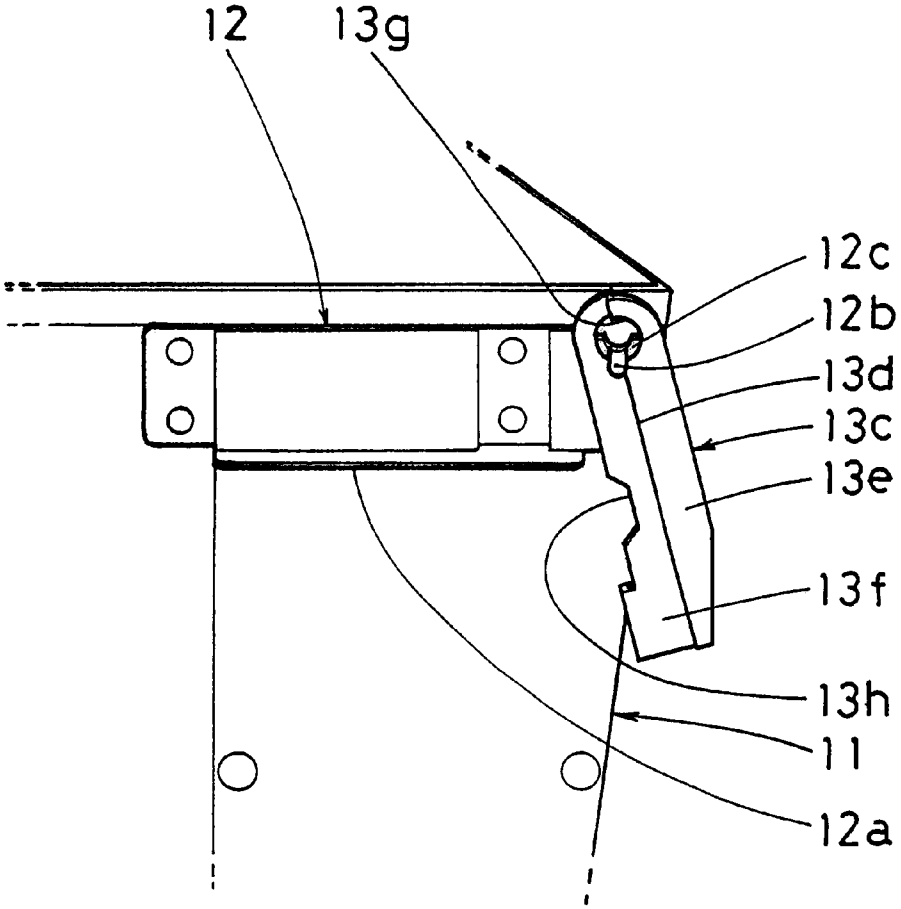
FIG. 4 is a perspective view of the mounting portion of the handle.

Each handle 13 includes a grip portion 13*a* having a hollow interior with a generally square section. Each handle 13 further includes two generally U-shaped engaging portions 13*b* formed on both ends of the grip portion 13*a* respectively. Each handle 13 further includes arms 13*c* formed on the engaging portions 13*b* respectively. As shown in FIGS. 3 and 4, each arm 13*c* has a lengthwise extending stepped portion 13*d*. Each stepped portion 13*d* divides the arm 13*c* into an upper half portion 13*e* and a lower half portion 13*f*. Each arm 13*c* has a through hole 13*g* formed through a distal end thereof and a notch 13*h* formed in the lower half portion 13*f*.

Each bracket 12 has a stopper 12*a* projecting integrally from a lower end thereof at one side thereof as shown in FIG. 4. Each bracket 12 further has a shaft pin 12 projecting from a right end thereof at one side thereof by means of pressing as viewed in FIG. 4. Each shaft pin 12*b* has a proximal end 12*c* having a generally semicircular section. Each bracket 12 is welded to an outer face of an upper corner of the body 11 while having a generally L-shaped one side laid on the bent portion 11*g* or 11*h* and the other side laid on the side wall 11*e* or 11*f*.

The proximal end 12*c* of the shaft pin 12*b* of the bracket 12 is fitted in the hole 13*d* of the arm 13*c*, and the distal end of the shaft pin 12*b* is bent so that the arm 13*c* is prevented from falling off, whereby each handle 13 is rotatably mounted on the outer face of the side wall 11*c* or 11*d* so as to be rotated to the inside of the body 11 and the outside of the body. As shown in FIGS. 1 and 3, when each handle 13 is rotated to the inside of the body 11, the engaging portion 13*b* thereof engages the upper end of the side wall 11*c* or 11*d* of the body 11, and each grip portion 13*a* extends across the open upper end of the body 11. In this case, the shape and dimensions of each engaging portion 13*b* are set so that each grip portion 13*a* is located lower than the upper end of the side wall 11*c* or 11*d*. Further, when each handle 13 is rotated to the outside of the body 11, the grip portion 13*a* disengages from the upper end of the body 11 to be rotated to the outside of the body.

Figure 5:
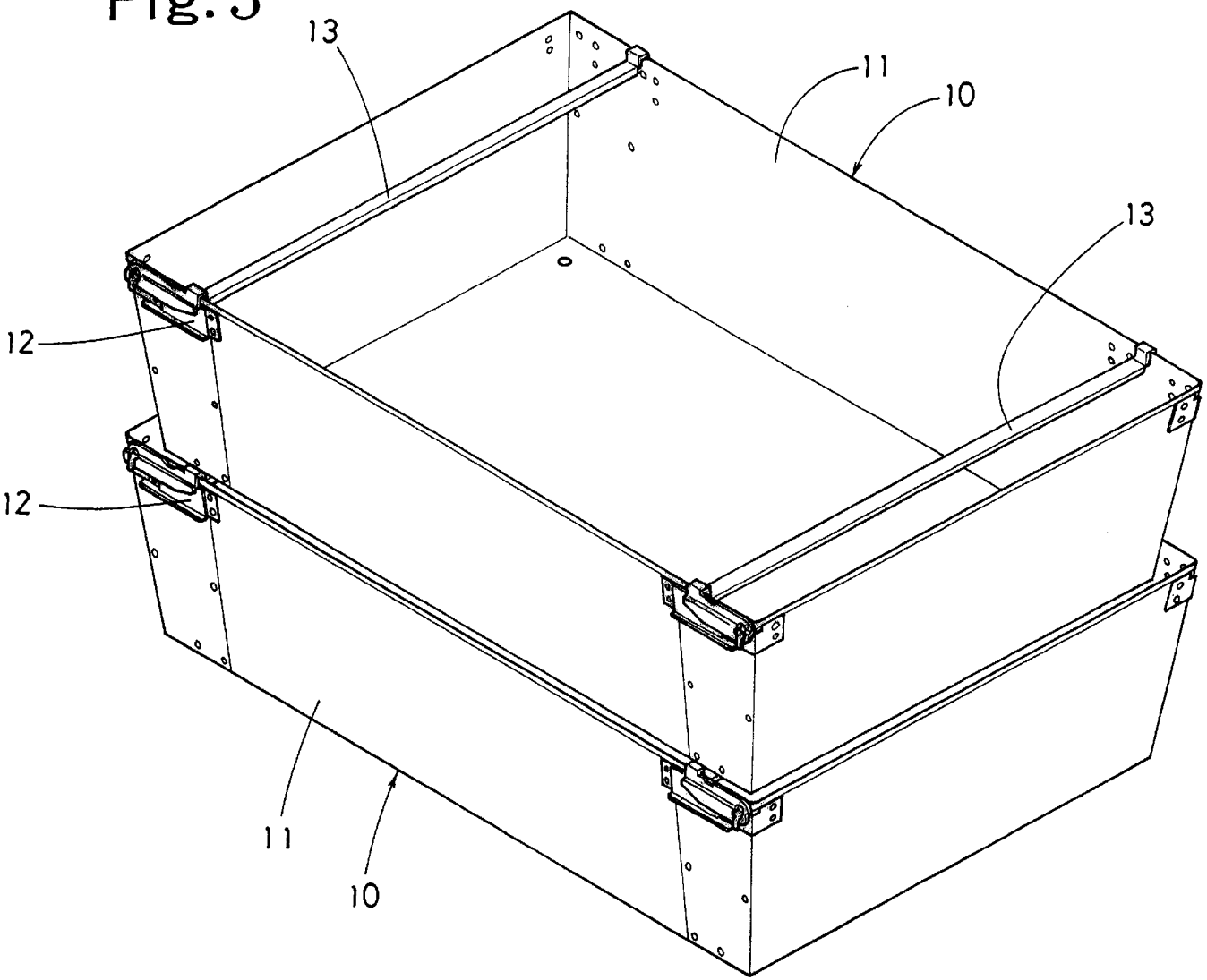
FIG. 5 is a perspective view of two containers with one being placed on grip portions of the other.
Figure 6:
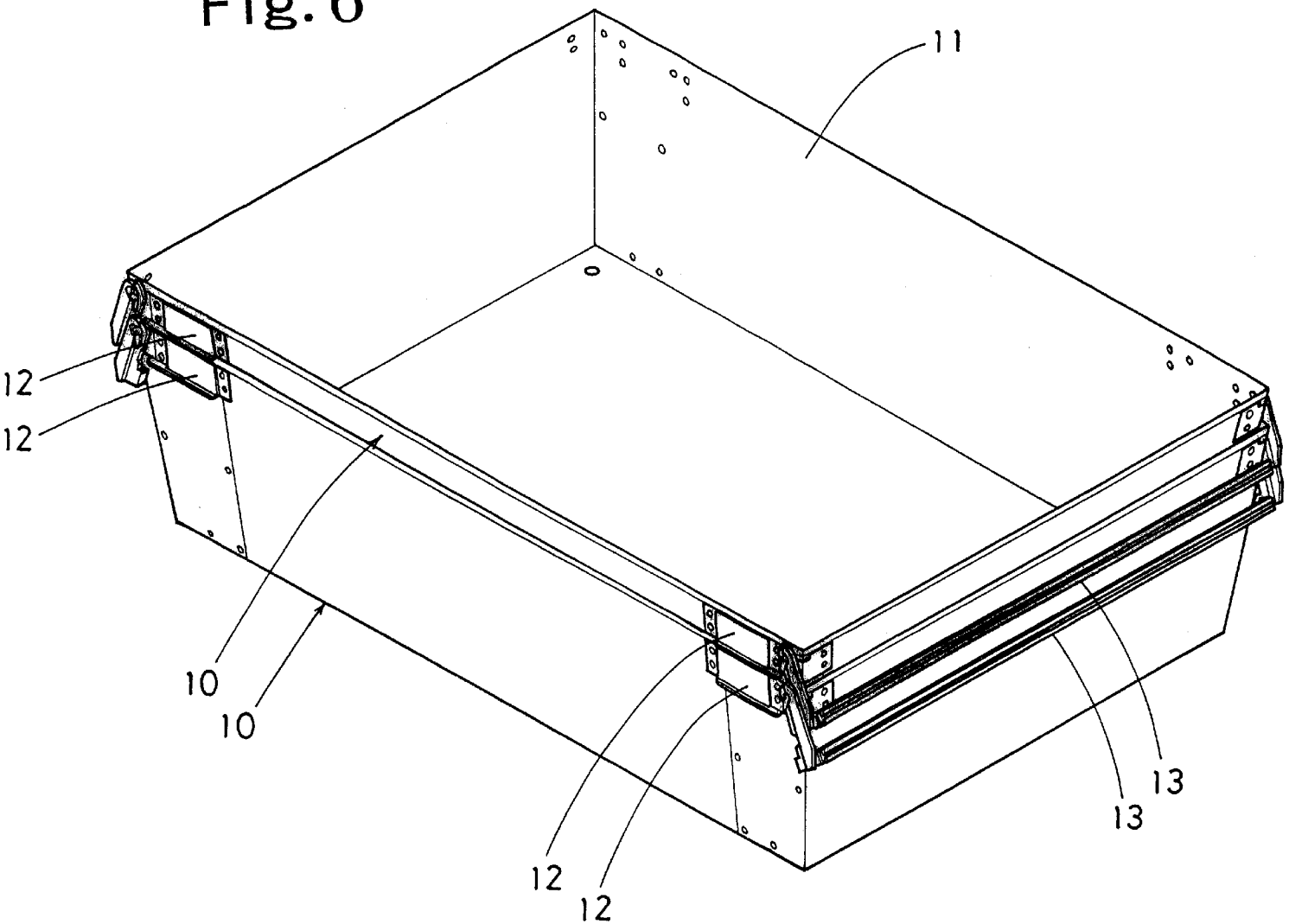
FIG. 6 is a perspective view of the two containers laid one upon the other for safekeeping.

The operation of the transportation container will now be described. When the container containing products is to be transported, the handles 13 are rotated to the inside of the body 11 so that the engaging portions 13*b* engage the upper ends of the side walls 11*c* and 11*d* respectively, as shown in FIG. 1. The bottom of another container 10 is placed on the grip portions 13*a* extending across the open upper end 11*a* of the body 11 so that said another container is laid on the container, as shown in FIG. 5.

Figure 7:
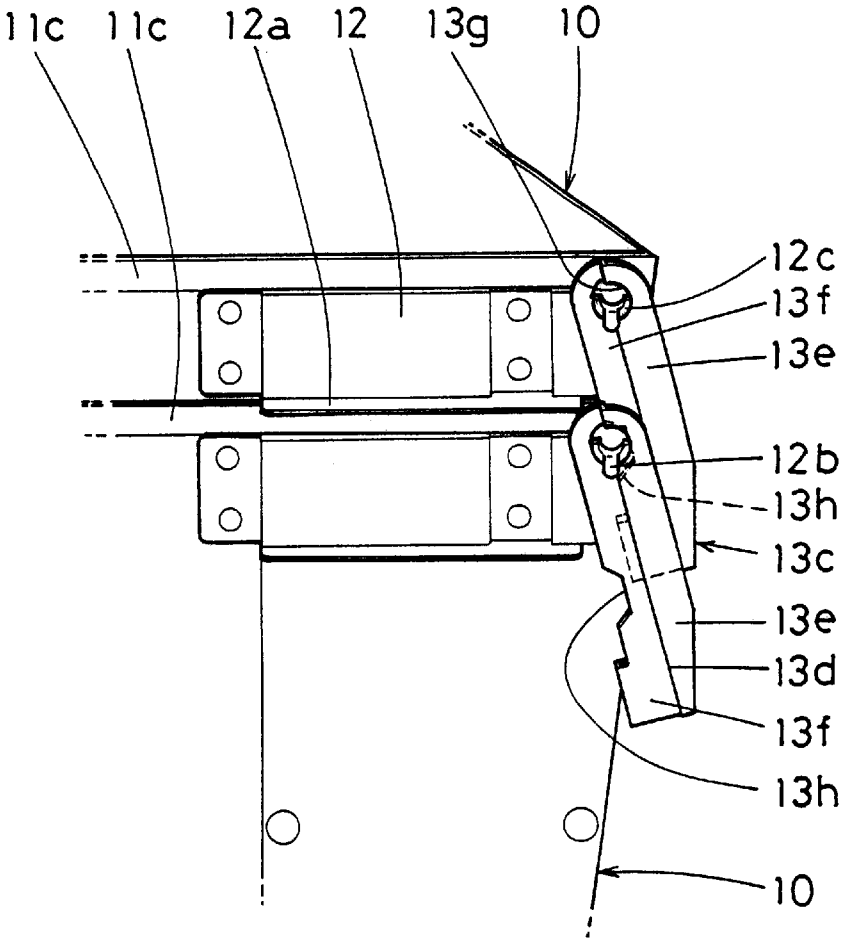
FIG. 7 is a partial perspective view of arms of the containers laid one upon the other.

When the containers are to be returned after transportation, the handles 13 are rotated to the outside of the body 11 so that the grip portions 13*a* are moved out of the open upper end 11*a* of the body 11, as shown in FIG. 2. Then, another container 10 is fitted into the container to be laid on the latter. Since the stoppers 12*a* of said another container 10 abut the upper ends of the side walls 11*c* and 11*d* of the container, a space is defined between the underside of the upper container 10 and the bottom 11*b* of the lower container 10, as shown in FIG. 7. Furthermore, the lower half portions 13*f* of the arms 13*c* of the upper container 10 are located inside the upper half portions 13*e* of the arms 13*c* of the lower container 10 respectively. The proximal ends 12*c* of the shaft pins 12*b* of the lower container 10 are fitted into the notches 13*h* of the arms 13*c* of the upper container 10 respectively.

According to the above-described embodiment, the arms 13*c* of each handle 13 of the container 10 are assembled onto the outer faces of the side walls 11*c* and 11*d* respectively. Accordingly, when the handles 13 are rotated to the outside of the body 11, one container 10 can be fitted into another container 10 such that the containers 10 are laid one upon another. When not used, the containers 10 can be put one upon another so as to be stored. Consequently, a space required for storage can be saved.

On the other hand, when the container 10 containing products is used for transportation, the handles 13 are rotated to the inside of the body 11 so that the engaging portions 13*b* engage the upper ends of the side walls 11*c* and 11*d* of the body 11 respectively. As a result, since the grip portions 13*a* of the handles 13 extend across the open upper end of the body 11, one container 10 can be placed on the grip portions 13*a* of another container 10. Further, the grip portions 13*a* are located below the upper ends of the side walls 11*c* and 11*d* when the engaging portions 13*b* are in engagement with the upper ends of the side walls, respectively. As a result, the bottom 11*b* of the upper container 10 is put into the lower container 10. Accordingly, even if the containers 10 are slid horizontally, the bottom 11*b* of the upper container 10 strikes against the side walls 11*c* to 11*f* of the lower container 10 such that the containers laid one upon another can be prevented from falling down.

When the containers 10 are fitted into one another to be laid one upon another, the stoppers 12*a* defines the space between the lower container 10 and the bottom 11*b* of the upper container 10 laid upon the lower one, whereupon the containers 10 can be prevented from closely adhering to one another. Consequently, the containers 10 laid one upon another can easily be detached from one another.

When one container 10 is fitted into another container 10 to be laid upon the latter, the lower half portions 13*f* of the arms 13*c* of the upper container 10 are located inside the upper half portions 13*e* of the arms 13*c* of the lower container 10 respectively. As a result, since the arms 13*c* of the upper container 10 partially overlap the arms 13*c* of the lower container 10, the dimension of a protruding portion of each arm 13*c* or grip portion 13*a* is reduced, a space used for safekeeping of the containers 10 can be saved.

Since each grip portion 13*a* has a hollow interior with a generally square section, the bottom 11*b* of one container 10 is stably laid on the grip portions 13*a* of the lower container 10. Consequently, the containers 10 can easily be laid one upon another. Furthermore, since the upper corners of the body 11 are reinforced by the brackets 12 respectively, the container is hard to deform due to the self weight when products are accommodated therein, and the container 10 can repeatedly be used.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. A transportation container comprising:

a body having a plurality of side walls, a bottom and an open upper end with two pairs of corners, the side walls being inclined downwardly inward so that a cross-sectional area of the body is gradually decreased from the upper end to the bottom of the body;

a pair of handles mounted on the body so as to be rotated inside or outside the body and including grip portions having both ends respectively;

a pair of arms formed on the respective ends of each grip portion of each handle, each arm having a distal end mounted on an outer face of one of the side walls of the body so that each handle is rotated inside or outside the body; and a pair of engaging portions formed on an interface between each grip portion and the corresponding arm, each engaging portion engaging the upper end of the body and each grip portion extending across the open upper end of the body and being located lower than an upper end of the side wall when each handle is rotated inside the body, each engaging portion disengaging from the upper end of the body and each grip portion being rotated outside the body when the handle is rotated outside the body; and wherein each arm includes a stepped portion dividing each arm into an upper half portion and a lower half portion both extending lengthwise with respect to each arm, and the lower half portion of each arm of one container is placed inside the upper half portion of each arm of another container when said one container is fitted with said another container to be laid upon said another container.

2. The transportation container according to claim 1, further comprising a stopper protruding from an upper outer face of one of the side walls of the body, wherein when the body of one transportation container is fitted into the body of another transportation container so that the containers are laid one upon the other, the stopper of said other container strikes against an upper end of one of the side walls of said one container such that a space is defined between the underside of said one container and the bottom of said another container.

3. The transportation container according to claim 1, wherein each grip portion has a generally square section.

4. The transportation container according to claim 2, wherein the body has at least one corner, the container further comprising a generally L-shaped bracket secured to an outer face of the corner of the body, the stopper being formed integrally on the bracket.

* * * * *